United States Patent [19]

Weiss et al.

[11] 4,161,853

[45] Jul. 24, 1979

[54] RESILIENT WALL PROTECTOR

[75] Inventors: Kenneth Weiss, Plainview; Martin Fieder, Scarsdale, both of N.Y.

[73] Assignee: A. R. Nelson Co., Inc., Long Island City, N.Y.

[21] Appl. No.: 854,805

[22] Filed: Nov. 25, 1977

[51] Int. Cl.[2] ..... E04B 5/00

[52] U.S. Cl. ..... 52/288; 52/254; 52/717

[58] Field of Search ..... 52/288, 290, 242, 717, 52/718, 716, 254, 256, 287, 241, 360

[56] References Cited

U.S. PATENT DOCUMENTS

| | | | |
|---|---|---|---|
| 3,606,433 | 9/1971 | Kunevicius | 52/718 |
| 3,712,003 | 1/1973 | Hallock | 52/254 |
| 3,717,968 | 7/1973 | Olsen | 52/288 |
| 3,742,668 | 7/1973 | Oliver | 52/288 |
| 3,825,229 | 7/1974 | Bartlett | 52/716 |
| 3,861,110 | 1/1975 | Bartlett | 52/718 |
| 4,104,839 | 8/1978 | Blazer | 52/288 |

*Primary Examiner*—Price C. Faw, Jr.
*Assistant Examiner*—Henry E. Raduazo
*Attorney, Agent, or Firm*—Lackenbach, Lilling & Siegel

[57] ABSTRACT

A wall protector includes a retainer member adapted to be connected to a wall surface to be protected, a pair of spaced locking portions generally project outwardly from a wall portion of the retainer member. A resilient member configurated to substantially cover the retaining member when mounted thereon is provided which has a pair of spaced engaging portions projecting towards the retainer member and adapted to snappingly engage the locking portions and maintain the retainer and resilient members spaced from each other at a predetermined distance. Application of inward pressures on the resilient member towards the retainer member causes the resilient member to at least partially deform and cause the locking and engaging portions to separate from each other along the direction of the wall portions while still maintaining locking engagement therebetween and the wall protector members.

12 Claims, 6 Drawing Figures

10
12
12a
12b
12c
12d
12e
12f
12g
12h
12i
12k
12l
14
14a
14b
14b'
14c
14d
14e
14f
16
18
20
22
22a
22b
2
4

RESILIENT WALL PROTECTOR

BACKGROUND OF THE INVENTION

This invention relates generally to wall protectors and, more specifically, to a resilient wall protector assembly which includes a retainer member fixedly mounted on the wall surface to be protected, and a resilient member which is movably supported on the retainer member for relative movements thereto upon impact against the resilient member with resulting deformation thereof.

Wall surfaces in hallways are frequently exposed to impact forces and other abuse. This is particularly true in hospitals or other such heavily trafficked buildings where damage to the walls or wall corners mays result in the ordinary use of the building as a result of the careless use of carts, patient moving vehicles, and movement of furniture and/or equipment. An impact or scrapping force on a wall may, for example, chip or break a ceramic tile, or dent or otherwise cause deterioration of a plaster wall.

In order to prevent damage to the wall surfaces of public buildings, bumpers or rails of various types have been mounted on the walls and wall corners. Frequently, such protective elements are unsightly. In order to be effective and prevent damage to the wall, the bumbers or rails must be capable of absorbing the impact forces while transmitting a minimal amount of such forces to the supporting wall structure.

Numerous bumpers or rails are known in the prior art. For example, corner guards for protecting wall corners are disclosed in U.S. Pat. Nos. 2,072,884; 3,133,326; 3,559,356; 3,712,003 and 3,717,968. The devices disclosed in the last three-numbered patents are typical of the known constructions, these utilizing retainer members which are adapted to be fixedly mounted to the corner to be protected, the retainers defining elongate channels on each side of the wall forming the corner. Resilient strips bridge the corner and have the free edges thereof received within the channels defined by the retainer members. Upon impact, the resilient member deforms and causes the edges of the resilient member to move within the retainer channels. However, the prior art corner guard constructions have generally been inconvenient to install. Additionally, the resiliency and the ability to form restoring forces was normally only a function of the configuration, dimensions and nature of the material of the resilient member. This has sometimes required the selection of resilient materials which are either too hard and transmit too much of the impacting forces to the supporting wall structure, or too soft to result in excessive deformation thereby transmitting impact forces to the underlying wall support structure.

Generally, the prior art corner quard constructions have either been too complex in construction and, therefore, too expensive to manufacture and assemble, or have been ineffective for their intended uses.

Another construction for a corner guard is disclosed in the Specification sheet No. 10 (10.6/Paw) of the Pawling Rubber Corporation of Pawling, New York, and dated January, 1974; and in the Specification Sheet AFP/103 of the American Floor Products Company of Rockville, Maryland. Both of these specification sheets disclose a corner guard construction which is very similar and includes aluminum retainers provided with continuous pincer-like channels adapted to receive beads or projections extending from the inner surface of a resilient corner guard configurated to overlap the retainer. However, the prior art corner guards under discussion generally retrain relative movements between the retainer and the resilient corner guard so as to prevent substantial absorption of impact forces. Additionally, alignment of the beads or projections with the openings of the pincer-like channels may make it difficult or inconvenient to assemble this prior art corner guard construction.

Bumper guards for surface mounting on flat walls are also known. For example, wall guards are described in U.S. Pat. Nos. 1,980,347 and 3,861,110. In the last mentioned patent, a retainer is provided, and a resilient bumper member is provided which has divergent legs each of which has an inwardly facing channel at the free end. When placed on the retainer, the channel fits over the side edges of the retainer. However, with this arrangement, the resiliency and the capacity for generating restoring forces are only a function of the thickness and the material of the resilient member, as with the above described corner guard constructions. Additionally, with this construction, the resilient member can be removed or inadvertently separate from the supporting retainer. This makes the loss of the resilient members a possibility either as a result of accident or vandalism.

A combination hand rail and wall protector is also known and described in U.S. Pat. No. 3,825,229. Here, a rigid retainer is mounted on the wall and a resilient trim piece is received on the retainer. However, this construction suffers the same disadvantages as described in connection with the last mentioned bumper guard which forms the subject of U.S. Pat. No. 3,861,110.

SUMMARY OF THE INVENTION

Accordingly, it is an object of the present invention to provide a resilient wall protector which does not have the disadvantages associated with prior art comparable devices.

It is another object of the present invention to provide a resilient wall protector which is simple in construction, and economical to manufacture.

It is still another object of the present invention to provide a resilient wall protector which is simple to assemble.

It is yet another object of the present invention to provide a resilient wall protector whose novel features can be incorporated either in corner guards, bumper, chair rail or hand rail constructions.

It is a further object of the present invention to provide a resilient wall protector which permits relative movement between the supporting retainer member and the resilient covering member during deformation of the resilient member upon impact thereon.

It is still a further object of the present invention to provide a resilient wall protector as suggested in the last object, which includes means for resiliently limiting excessive relative movements between the retaining and resilient members.

It is yet a further object of the present invention to provide resilient wall protectors which can be either recessed or surface mounted.

It is yet a further object of the present invention to provide a resilient wall protector which includes means for resiliently limiting excessive relative movements between the retainer and resilient members upon impact.

In order to achieve the above objects, as well as others which will become apparent from the description that follows, a resilient wall protector in accordance with the present invention comprises a retainer member adapted to be connected to a wall surface to be protected and having at least one locking portion generally projecting outwardly from the wall portion of said retainer member. A resilient member is provided which is configurated to substantially cover said retainer member when mounted thereon. Said retainer member has at least one engaging portion projecting towards said retainer member and adapted to snappingly engage said locking portion and generally maintain said retainer and resilient members spaced from each other at a predetermined distance. Application of inward pressures on said resilient member towards said retainer member causes said resilient member to at least partially deform and causes said locking and engaging portions to separate from each other along the direction of said wall portion while still maintaining locking engagement between said portions and said members.

BRIEF SUMMARY OF THE DRAWINGS

Further advantages of the invention will become apparent from a reading of the following specification describing illustrative embodiments of the invention. This specification is to be taken with the accompanying drawings in which.

DESCRIPTION OF THE PREFERRED EMBODIMENTS

Figures 1, 2, 3:
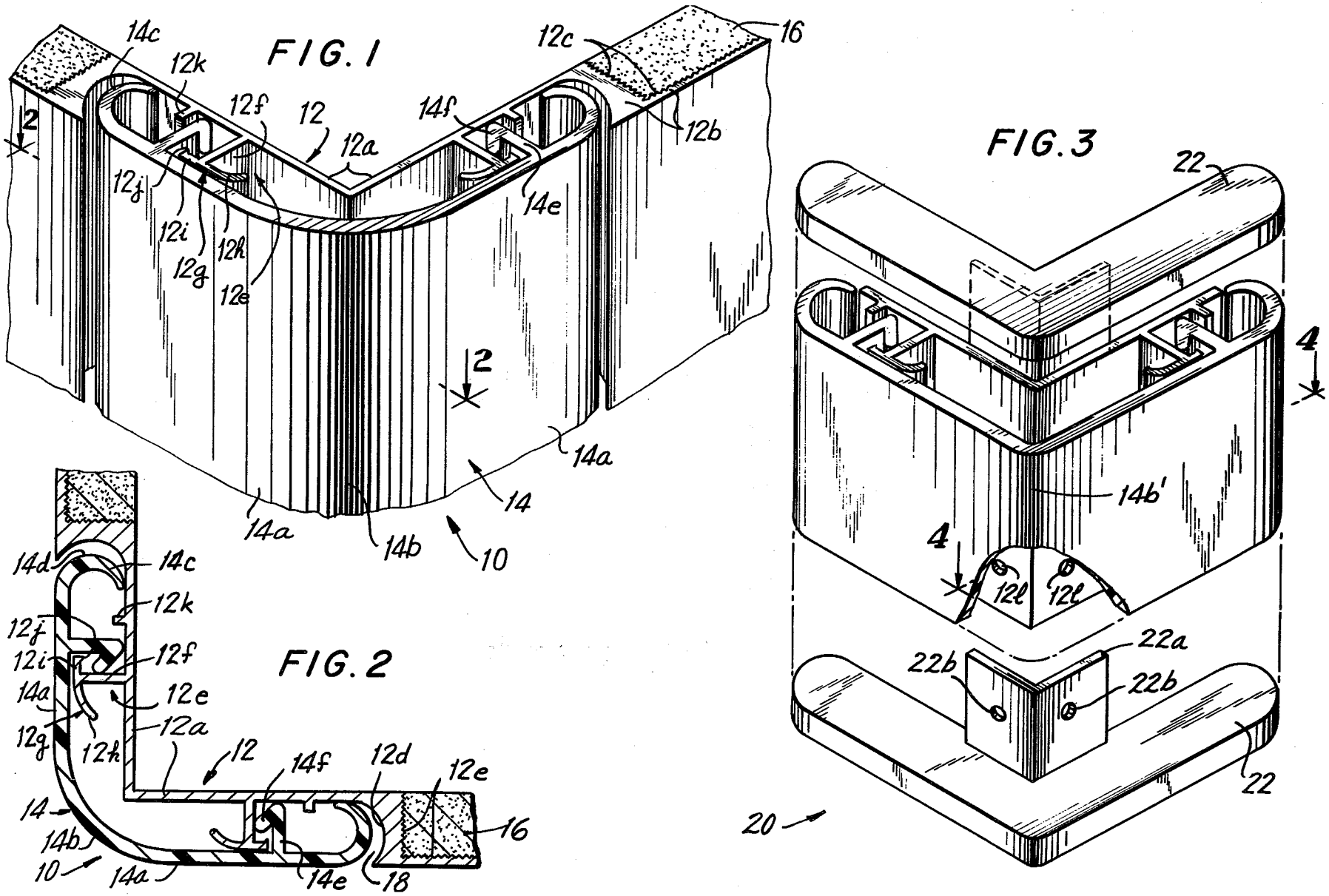
FIG. 1 is a perspective view of a corner guard construction in accordance with the present invention, showing a recessed corner guard and the manner in which the resilient member is engaged in locking relation with the retainer which is mounted on the wall corner to be protected.
FIG. 2 is a sectional view of the corner guard construction shown in FIG. 1, taken along line 2—2.
FIG. 3 is an exploded perspective view similar to that of FIG. 1, showing a surface-mounted corner guard, and upper and lower caps for closing and sealing the spaces and channels between the retainer and resilient members from dust and other contaminants.

Referring now to the Figures, wherein identical or similar parts are designated by the same reference numerals throughout, and first referring to FIG. 1, a resilient wall protector in the nature of a corner guard is designated by the reference numeral 10.

The corner guard 10 includes a generally L-shaped retainer 12 which, in accordance with the presently preferred embodiment, is in the nature of an aluminum extrusion having a cross-sectional configuration as shown in FIGS. 1 and 2. The retainer or retainer member 12 is adapted to be connected to a wall surface to be protected or a wall corner in the instance of the corner guard 10.

A resilient member 14, to be decribed in detail, is provided which is configurated to substantially cover the retainer 12 when mounted thereon as shown in FIGS. 1 and 2. The resilient member 14 cooperates with the retainer 12 to provide effective cushioning of the wall corner as will become evident hereafter.

The retainer 12 has two diverging walls or legs **12*a* which are normal to one another and meet at a right angle edge. While it is not a critical feature of the present invention, the retainer 12 and the resilient member 14 are generally symmetrical about the right angle edge, the constructions on the two sides of the right angle edge being mirror images of each other. Accordingly, only one side of the corner guard 10** need be described, since the other side is substantially identical thereto and operates in a similar manner.

The retainer legs **12*a* are terminated at the free ends thereof with plaster stops 12*b* which may be of any conventional type and are shown to comprise L-shaped end portions, the inside surfaces of which are provided with serrations 12*c*. The serrations 12*c* are intended to provide a better joint or bond with the plaster 16 of the wall to be protected when the corner guard 10 is recessed as shown in FIGS. 1 and 2**.

As shown in the figures, the plaster stops **12*b* are provided with curved cylindrical surfaces 12*d* which face the resilient member 14 and are spaced therefrom by a clearance or distance 18**. The purpose of this clearance will become apparent from the description that follows.

The resilient member 14 is also shown to be L-shaped and has two end flat portions **14*a* and an intermediate curved portion 14*b* connecting the flat end portions. The flat end portions are provided with in-turned curved edge portions 14*c* which define curved surfaces 14*d* which generally correspond in curvature to the curved surfaces 12*d* of the plaster stops 12*b***.

In accordance with the broader features of the present invention, the retainer member 12 is provided with at least one locking portion which is generally designated by the reference numeral **12*e* in FIG. 1, although two locking portions are provided in the presently preferred embodiment of the corner guard 10 each of which projects outwardly from a wall portion of the retainer member 12** as shown.

The resilient member 14 has at least one engaging portion, which includes a resilient rib **14*e* terminating in a hook portion 14*f*. The rib 14*e* projects towards the retainer member 12 and, with the hook portion 14*f*, is adapted to snappingly engage the locking portion 12*e* and generally maintain the retainer 12 and the resilient member 14 spaced from each other at a predetermined distance. Application of inward pressures on the resilient member 14 towards the retainer member 12 causes the resilient member 14 to at least partially deform and cause the locking portion 12*e* and the engaging portions 14*e*, 14*f* to separate from each other along the direction of the retainer legs 12*a*** while still maintaining locking engagement between the retainer and resilient members.

The locking portion **12*e*, in accordance with the present invention, includes a supporting rib 12*f* generally normal to the wall portions or legs 12*a*, and a guide portion 12*g* generally normal to the supporting rib 12*f* at the end thereof remote from the retainer legs 12*a*. The supporting rib 12*f* is connected to the guide portion 12*g*** at an intermediate portion thereof to define a leading guide portion 12*h* and a trailing guide portion 12*i*, the leading guide portion 12*h* being curved and disposed generally opposite the hook portion 14*f* prior to assembly of the wall protector, and the trailing guide portion 12*i* is generally straight and disposed opposite the hook portion 14*f* subsequent to assembly of the wall protector.

With this construction, the hook portion 14*f* is adapted to be initially guided along the guide portion 12*g* during assembly of the wall protector and to be snappingly received between the guide portion 12*i* and the wall portion or retainer leg 12*a*. Once assembled, application of inward pressures on the resilient member 14 towards the retainer member 12 causes the resilient member 14 to at least partially deform and causes the locking portions 12*e* and the engaging portions 14*e*, 14*f* to separate from each other along the direction of the retainer legs 12*a* while still maintaining locking engagement between the hook portions 14*k* and the trailing guide portions 12*i*. Towards this end, the trailing guide portions 12*i* are provided with inwardly turned edges or lips 12*j* to prevent the hook portions 14*f* from moving out of the space formed by the retainer legs 12*a* and the trailing guide portions 12*i*.

A further feature of the present invention is the provision of an end limit rib or stop 12*k* projecting from the wall portions or legs 12*a* and spaced from the locking portions 12*e* to prevent excessive relative movement between the resilient member engaging portions, which include resilient ribs 14*e* and hook portions 14*f*, and the locking portions 12*e* and limit such relative movements to a predetermined or desired amount.

Advantageously, the clearance or distance 18 between the curved surfaces 12*d* and 14*c* of the retainer and resilient members 12, 14 respectively, is selected to cause the resilient rib 14*e* to abut against the end limit rib or stop 12*k* prior to engagement between the curved surface 12*d*, 14*d*. In this manner, deformation of the resilient member 14 produces restoring forces which include restoring forces produced in the resilient rib 14*e* as a result of its deformation upon abutment against the end limit ribs or stops 12*k*. Accordingly, excessive deformation will first be prevented by abutment between the resilient ribs 14*e* and the end limit ribs or stops 12*k*. Subsequent deformation of the resilient member 14 may bring the curved surfaces 12*d* and 14*d* into abutting contact, this still further producing restoring forces which prevent excessive deformation of the resilient member 14 which may result in direct application of forces to the retainer 12 and thus to the wall corner itself.

The resilient member 14 may be made from any hard impact plastic or rubber, such as vinyl. Any conventional material which is utilized for this purpose may be used.

Figure 4:
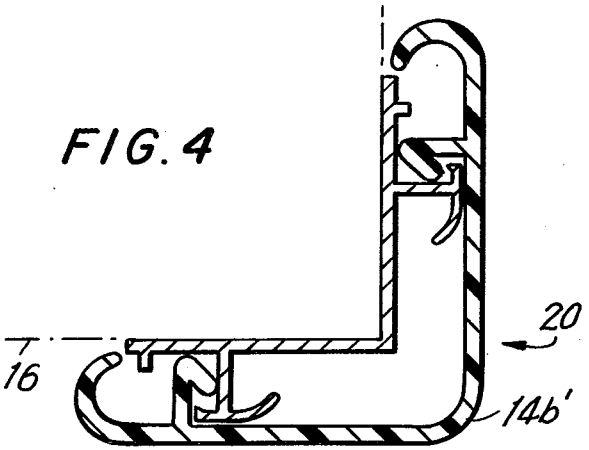
FIG. 4 is a top plan view, in cross section, of the corner guard construction shown in FIG. 3, showing the manner in which the surface mounted corner guard is mounted on a wall surface.

Referring to FIG. 3, a corner guard very similar to that shown in FIGS. 1 and 2 is illustrated and identified by the reference numeral 20. The corner guard 20 is a surface mounted version of the corner guard 10, and is mounted on the surface of the wall 16 as suggested in FIG. 4. Accordingly, the corner guard 20 does not have the plaster stop portions 12*b*, although the operation of the corner guard is otherwise identical. It may be noted in this connection that while the curved edge portion 14*b* in FIGS. 1 and 2 is shown to have a somewhat greater radius, the curved edge portion 14*b'* in FIGS. 3 and 4 is much smaller. Clearly, the actual radius of curvature of such curved edge portion is a matter of design choice and must be selected as may be appropriate for the particular application.

Still referring to FIG. 3, there are provided upper and lower caps 22 which are configurated to correspond to the end or cross-sectional configuration of the corner guard 20. The caps 22 include means for securing the same to the corner guard 20. In the embodiment being described, the caps are provided with L-shaped brackets 22*a* which project therefrom as shown in FIG. 3, which brackets have holes 22*b* which are arranged to be aligned with corresponding holes 121 in the retainer member 12 so as to permit suitable fastening means, such as bolts or rivets to join the caps to the retainer member. The holes 22*b* and 121 need not be predrilled as shown but may be drilled once the caps are positioned in their permanent positions on the retainer members 12 but prior to assembly of the protector 20. The end caps 22 substantially prevent dust and other contaminants from entering the wall protector and increase the aesthetic appearance of the assembled corner guards or the like by providing a finished appearance thereto.

To assemble the corner guards 10 or 20, the retainer members 12 are secured to the wall corners in a conventional manner, whether the corner guards are to be recessed or surface mounted.

By making the guide portions 12*g* hammer-shaped as shown, they provide cam surfaces. Initially, when the hook portions 14*f* are brought into contact with their associated or cooperating locking portions 12*e*, the hook portions abutting against the curved or leading guide portions 12*h*. Application of pressure on the resilient member 14 causes the hook portions 14*f* to ride on the guide portions 12*g* and ultimately snap behind the straight or trailing guide portions 12*i*. Once the hook portions 14*f* are received within the space formed by the trailing guide portion 12*i*, the wall portion or leg 12*a*, the supporting rib 12*f* and the end limit rib or stop 12*k*, it becomes virtually impossible to remove the hook portion from such space. Yet, the resilient rib 14*e* and hook portion 14*f* have a substantial degree of freedom for lateral movement along the directions of the retainer legs 12*a* whereby the hook portions 14*f* move between the supporting ribs 12*f* and the end limit rib or stops 12*k*. Accordingly, the corner guards provide a reliable assembly which cannot inadvertently become disassembled.

The construction of the invention as described above provides satisfactory cushioning of impacting forces, since restoring forces on the resilient member 14 are not only a function of the thickness and configuration of the flat and curved portions 14*a*, 14*b*, but also a function of the characteristics of the resilient rib 14*e*, and the spacing or distance between the supporting rib 12*f* and the end limit rib or stop 12*k*. Being resilient, the rib 14*e* contributes towards the restoring forces upon abutting engagement with the end limit rib or stop 12*k* with attendant deformation of such resilient rib or ribs 14*e*.

While assembly may be affected as suggested above, namely snapping engagement at both locking portions 12*e*, it is, of course, possible to initially position one of the hook portions behind its associated trailing guide portion 12*i* by suitably orienting the retainer and resilient members, and subsequently snapping engaging only the other of the hook portions 14*f*. Additionally, it is also possible to merely slidingly engage the retainer and resilient members by placing the same end to end and initially guiding the hook portions 14*f* behind the trailing guide portions 12*i*, and subsequently sliding the retainer and resilient members 12, 14 into co-extensive or opposing relation as shown in the figures. This may be the least practical approach in certain field applications. It has been found that the first described method, namely simply forcing the resilient member 14 against the retainer member 12 to cause the hook portions 14*f* to simultaneously or substantially simultaneously to snappingly engage the locking portions 12*e*, is satisfactory.

Figure 5:
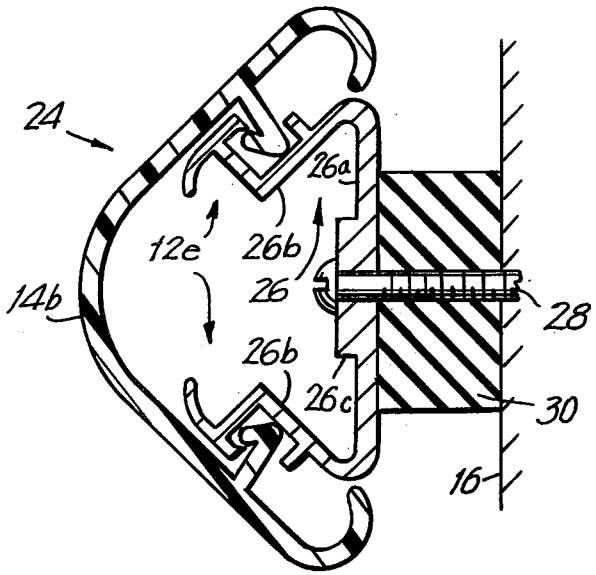
FIG. 5 is a side elevational view, in cross section, of a bumper or chair rail construction, incorporating the present invention.

The locking portions and engaging portions 12*e*, 14*e* and 14*f* can be used in wall protectors other than corner guards. Referring to FIG. 5, for example, there is shown a bumper and chair rail 24, wherein the retainer member 26 is shown to be generally C-shaped, having a flat mounting portion 26*a* and upper and lower inwardly turned wall portions 26*b*. Locking portions 12*e* identical to the ones described above are provided on each of the inwardly turned wall portions 26*b* as shown. The resilient member 14 is L-shaped as with the corner guards 10 and 20, a pair of engaging portions 14*e*, 14*f* projecting inwardly from the resilient member and adapted to abut against and snappingly engage the locking portions 12*e* on the retainer member 26 during assembly of the bumper and chair rail 24.

The retainer 26 includes an enlarged thickness portion 26*c* which is provided with one or more holes therein for passage of bolts 28. The retainer 26 may be used in conjunction with toggle bolts and wood blockings, well known to those skilled in the art. The specific means for connecting the retainer members in the wall protectors of the present invention is not critical and any well known and conventional connecting or mounting means for such retainer members may be used.

Also shown in FIG. 5 is a cushion 30 which is disposed between the retainer 26 and the wall 16 to provide additional cushioning action. The size and thickness of the cushion 30 is a matter of design choice and can be selected as may be appropriate for a particular application.

Figure 6:
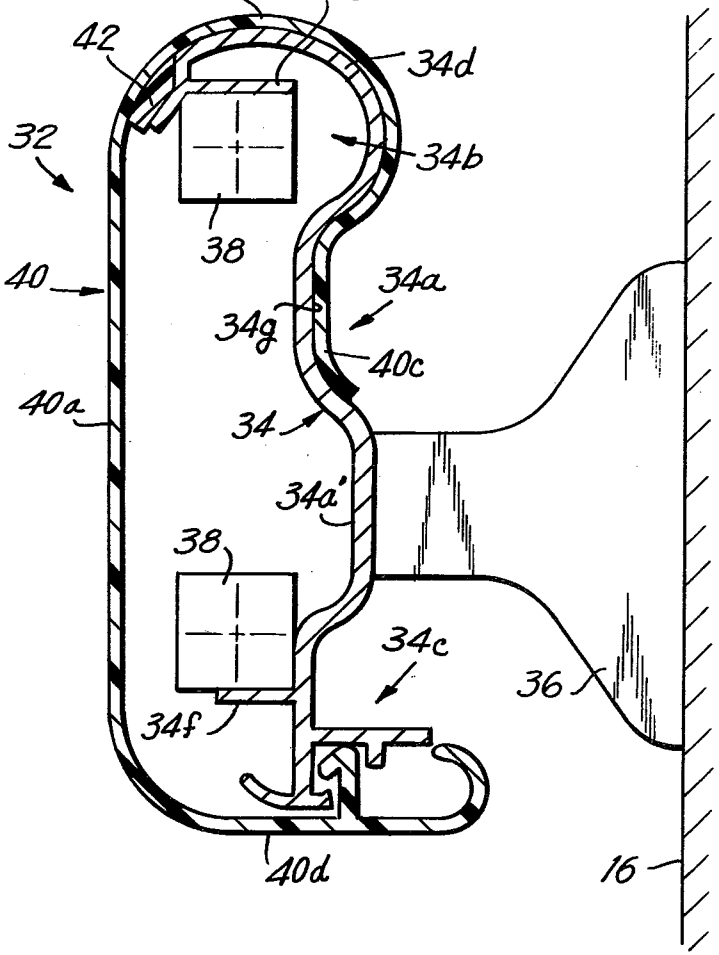
FIG. 6 is a side elevational view, in cross section, of a bumper or hand rail construction, incorporating the present invention.

The structural features in accordance with the present invention, and described above, can similarly be utilized in conjunction with hand rails. Referring to FIG. 6, such a hand rail is shown and identified by the reference numeral 32. Here, the retainer 34 includes a main body portion 34*a* which is generally vertically disposed when mounted on a wall surface 16, and includes a mounting portion 34*a'* adapted to be connected to the wall surface by means, for example, of a bracket 36. The retainer 34 also includes upper and lower retainer portion 34*b* and 34*c* respectively extending above the below the mounting portion 34*a'*. The upper retainer portion 34*b* has an outwardly curved upper end 34*d*, and the lower retainer portion includes a retainer wall portion from which projects a locking portion 12*e* as described above.

The resilient member 40 is generally coextensive with the retainer member 34 and has a front flat wall 40*a* which curves at the upper end to form an upper inwardly curved portion 40*b*, inwardly curved to correspond to the curvature of the curved upper end 34*d* of the upper retainer portion 34*b* to thereby mate and engage therewith as shown. The lower resilient portion 40*d* extends proximate to the locking portion 12*e* and has engaging portions 14*e*, 14*f* extending therefrom arranged to snappingly engage the locking portion 12*e* during assembly of the bumper and hand rail.

Advantageously, the main body portion 34*a* includes an offset portion 34*g* between the upper retainer portion 34*b* and the mounting portion 34*a'* which is recessed to provide an area of decreased thickness below the upper retainer portion 34*b* to conform the hand rail assembly to the shape of the human hand during holding or gripping to thereby provide a more comfortable grip to the use.

Also shown in FIG. 6 are upper and lower bracket support portions 34*e* and 34*f* which are disposed generally within the hand rail assembly, and are adapted to support splice angles 38 which are utilized for connecting end-to-end hand rail sections to each other at the adjacent ends thereof. The splice angles can also be utilized to connect a hand rail section to a 90° bend section which returns to the wall proper.

The retainer 34 may be so configurated so as to provide space between the retainer and the resilient member 40 for one or more cushions, such as the cushion 42. While only one cushion is shown, two or more cushions may, of course, be used as may be appropriate for a specific application.

The hand rail 32 provides a comfortable grip, and serves as a bumper or chair rail which protects the wall surfaces from various vehicles or other equipment frequently moved about in heavily trafficked hallways or public buildings, such as hospitals.

It is to be understood that the foregoing description of the various embodiments illustrated herein is exemplary and various modifications to the embodiment shown herein may be made without departing from the spirit and scope of the invention.

What is claimed is:

1. A resilient wall protector comprising a retainer member adapted to be connected to a wall surface to be protected and having at least one locking portion generally projecting outwardly from a wall portion of said retainer member; a resilient member configurated to substantially cover said retainer member when mounted thereon, said resilient member having at least one engaging portion projecting towards said retainer member and adapted to snappingly engage said locking portion and generally maintain said retainer and resilient members spaced from each other at a predetermined distance, application of inward pressures on said resilient member towards said retainer member causing said resilient member to at least partially deform and causing said locking and engaging portions to separate from each other along the direction of said wall portion while still maintaining locking engagement between said portions and said members; and an end limit rib or stop projecting from said wall portion and spaced from said locking portion to prevent excessive relative movement between said engaging and locking portions and limit such relative movement to a predetermined or desired amount.

2. A wall protector as defined in claim 1, wherein said locking portion comprises a supporting rib generally normal to said wall portion, and a guide portion generally normal to said supporting rib at the end thereof remote from said wall portion, and wherein said engaging portion comprises a resilient rib terminating in a hook portion adapted to be initially guided along said guide portion during assembly of the wall protector and to be snappingly received between said guide portion and said wall portion.

3. A wall protector as defined in claim 2, wherein said supporting rib is connected to said guide portion at an intermediate portion thereof to define leading and trailing guide portions, said leading guide portion being curved and disposed generally opposite said hook portion prior to assembly of the wall protector, and said trailing guide portion being generally straight and disposed opposite said hook portion subsequent to assembly of the wall protector.

4. A wall protector as defined in claim 3, wherein said trailing guide portion is provided with an inwardly turned edge or lip to prevent said hook portion from moving out of the space formed by said wall and trailing guide portions.

5. A wall protector as defined in claim 1, wherein said retainer member is adapted to be recessed in the wall to be protected and has a wall configurated to conform to the wall surface to be protected, said retainer wall having the free edges thereof formed with plaster stop portions.

6. A wall protector as defined in claim 5, wherein said resilient member has in-turned curved edge portions, and wherein said plaster stop portions have curved surfaces facing and generally corresponding in curvature to said in-turned curved edge portions.

7. A wall protector as defined in claim 1, wherein said plaster stop portions have surfaces facing and spaced from a surface of said retainer member to cause said engaging portion to abut against said end limit rib or stop prior to engagement between said surfaces of said stop portions and retainer member, whereby deformation of said resilient member produces restoring forces which include restoring forces produced in said engaging portion upon deformation of the same upon abutment agains said end limit rib or stop.

8. A wall protector as defined in claim 1, wherein the wall protector is a corner guard, and wherein said retainer member includes an L-shaped wall having two leg portions normal to each other, each leg portion being provided with one locking portion, said resilient member being L-shaped and having two end flat portions and an intermediate curved edge portion connecting said end flat portions, each of said end flat portions being provided with an engaging portion adapted to abut against and snappingly engage one of said locking portions on said retainer member during assembly of the corner guard.

9. A wall protector as defined in claim 1, further comprising at least one end cap configurated to correspond to the end or cross-sectional configuration of the wall protector and including means for securing said end cap to the wall protector, whereby said end cap substantially prevents dust and other contaminants from entering the wall protector and provides a finished appearance thereto.

10. A wall protector as defined in claim 1, wherein the wall protector is a bumper and chair rail, and wherein said retainer member includes a C-shaped wall having a flat mounting portion and upper and lower inwardly turned wall portions, locking portions being provided on each of said inwardly turned wall portions, said resilient member being L-shaped and having two end flat portions and an intermediate curved portion connecting said end flat portions, each of said end flat portions being provided with an engaging portion adapted to abut against and snappingly engage one of said locking portions on said retainer member during assembly of the bumper and chair rail.

11. A wall protector as defined in claim 1, wherein the wall protector is a bumper and handrail, and wherein said retainer member comprises a main body portion which is generally vertically disposed when mounted on a wall surface and includes a mounting portion adapted to be connected to the wall surface, and upper and lower retainer portions respectively extending above and below said mounting portion, said upper retainer portion having an outwardly curved upper end and said lower retainer portion including said retainer wall portion and a locking portion extending therefrom, said resilient member being generally coextensive with said retainer member and having upper and lower resilient portions, said upper resilient portion being inwardly curved to correspond to the curvature of said curved upper end of said upper retainer portion to thereby mate and engage therewith, said lower resilient portion extending proximate to said locking portion and having an engaging portion extending therefrom arranged to snappingly engage said locking portion during assembly of the bumper and handrail.

12. A wall protector as defined in claim 11, wherein said retainer main body portion includes an offset portion between said upper retainer and mounting portions which is recessed to provide an area of decreased thickness below said upper retainer portion and to conform to the shape of the human hand during holding or gripping to thereby provide a more comfortable grip to the user.

* * * * *